United States Patent [19]

Gilman

[11] 4,336,575

[45] Jun. 22, 1982

[54] BREAKAWAY PLASTER FRAME

[75] Inventor: Lester Gilman, South Hampton, Pa.

[73] Assignee: Kidde Consumer Durables Corp., Bala Cynwyd, Pa.

[21] Appl. No.: 183,877

[22] Filed: Sep. 4, 1980

[51] Int. Cl.[3] ..... F21S 1/02

[52] U.S. Cl. ..... 362/147; 362/364; 362/365; 362/418; 362/430

[58] Field of Search ..... 362/364, 365, 147, 418, 362/430

[56] References Cited

U.S. PATENT DOCUMENTS 4,188,656 2/1980 Howard ..... 362/365

4,294,615 6/1981 Chan et al. ..... 362/365

*Primary Examiner*—Stephen J. Lechert, Jr.

*Attorney, Agent, or Firm*—Seidel, Gonda, Goldhammer & Panitch

[57] ABSTRACT

A plaster frame has a breakaway zone which extends between a hole in the frame and a periphery of the frame. When the breakaway zone is removed, the frame may now be inserted through a hole in a ceiling which is approximately the same size as the hole in the plaster frame. An open bottom lighting housing is removably mounted on said plaster frame coaxial with the frame hole and prewired to a junction box on the plaster frame.

10 Claims, 5 Drawing Figures

FIG. 1
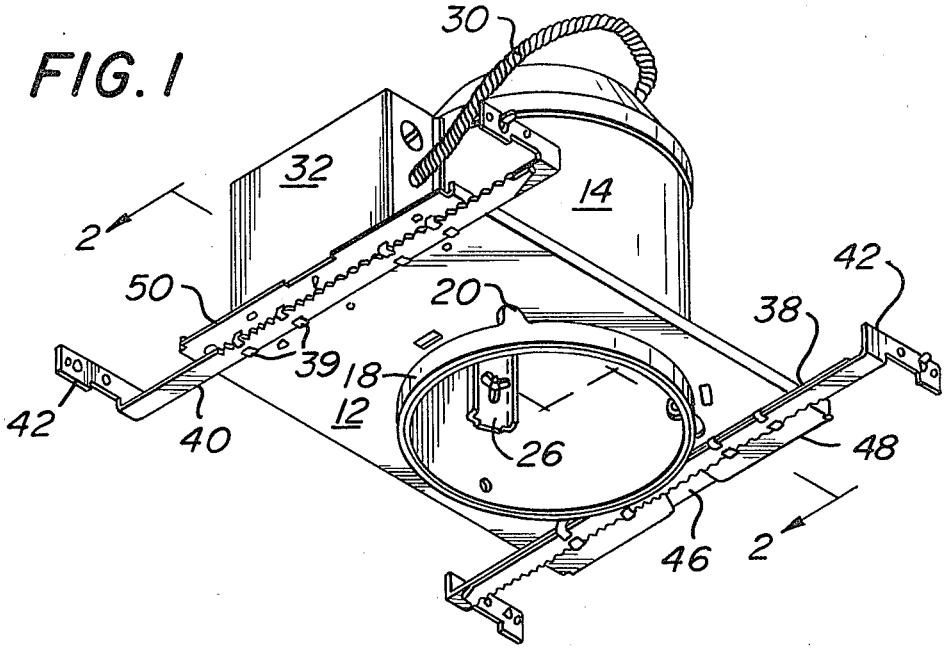
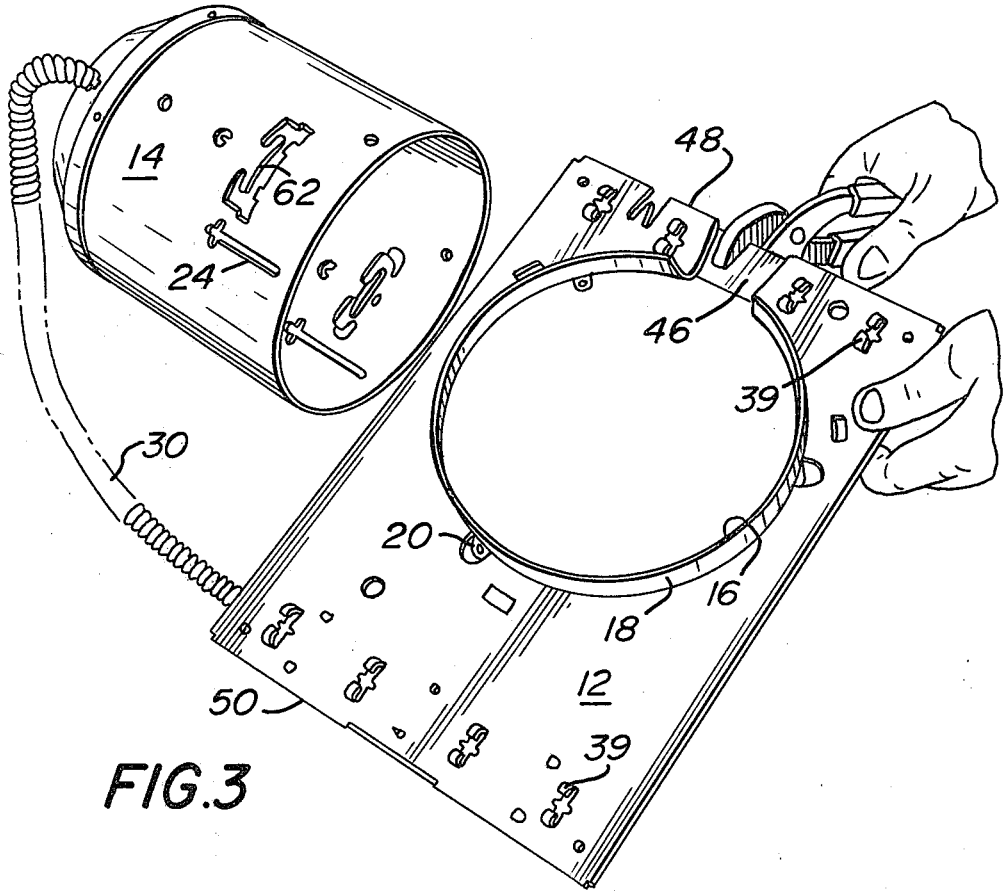
FIG. 3

BREAKAWAY PLASTER FRAME

BACKGROUND

Plaster frames of the general type involved herein are well known and have been used for many years when installing a fixture between joists in a ceiling under construction. Once the ceiling has been completed, an entirely different type of fixture is necessary since the peripheral dimensions of the plaster frame are substantially larger than the peripheral dimensions of the lighting housing. There is a need for a plaster frame which can be recessed in a completed ceiling while having peripheral dimensions substantially greater than the hole cut into the ceiling. A solution to the problem preferably includes a plaster frame constructed in a manner so that it may also be installed in a conventional manner.

SUMMARY OF THE INVENTION

The present invention is directed to a plaster frame having a hole therethrough and an integral breakaway zone extending from the hole to the periphery of the frame. An open bottom housing is removably mounted on the frame coaxial with said hole. The housing is shaped so that it can be passed entirely through said hole. The housing has a electrical receptacle for receiving an electric light source such as a light bulb. A box is secured in the upper surface of said plaster frame. Wires extend from said box to said receptacle.

It is an object of the present invention to provide a plaster frame which can be used in a conventional manner and which has a breakaway zone so that it may be inserted through a ceiling hole which is much smaller than the size of the plaster frame.

It is another object of the present invention to provide a plaster frame which is convertable so that it may be maneuvered through a small hole in an existing ceiling.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a perspective view of a plaster frame in accordance with the present invention.

FIG. 3 is a perspective view showing the housing disconnected from the frame and removal of the breakaway zone.

DETAILED DESCRIPTION

Figure 2:
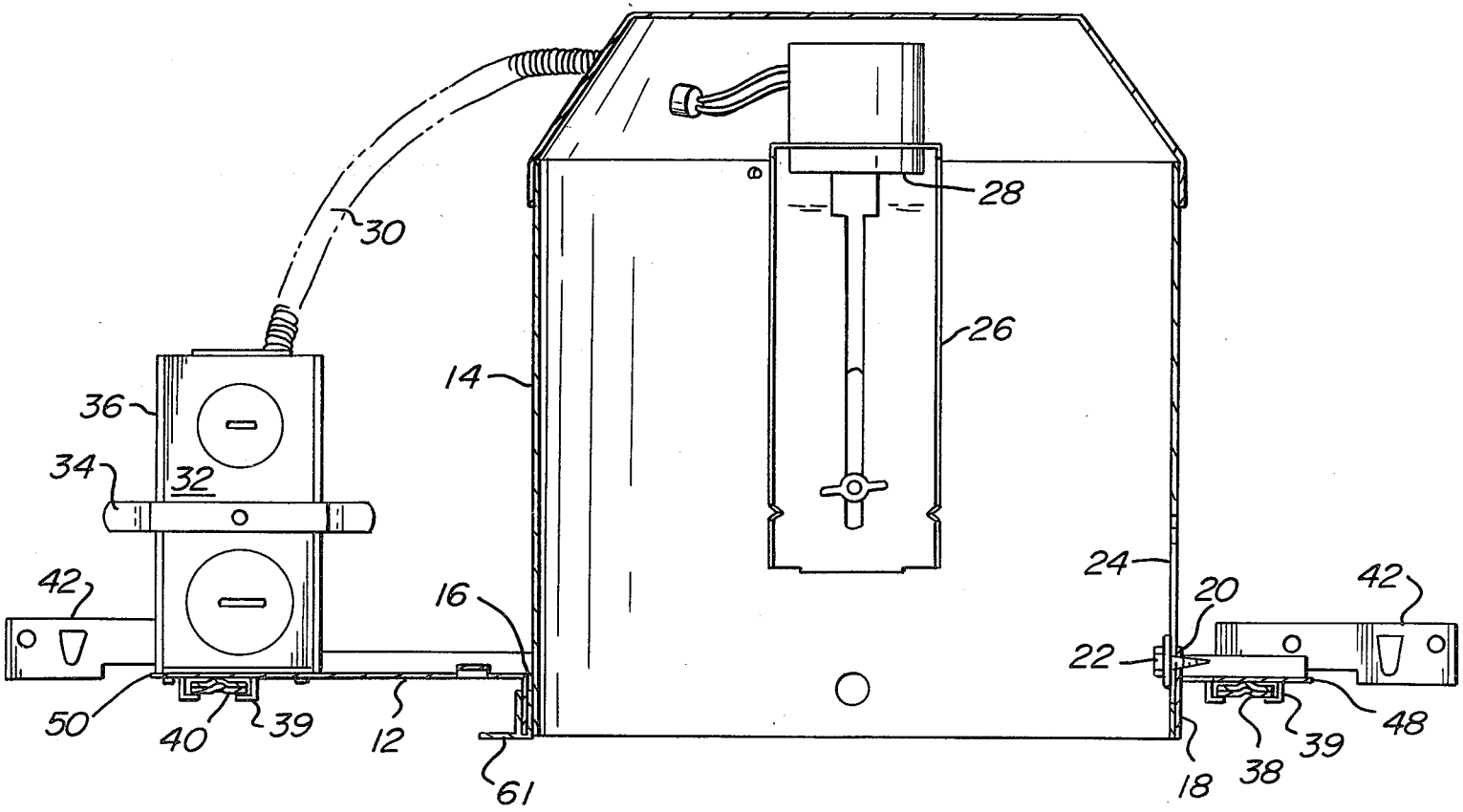
FIG. 2 is a transverse sectional view of the plaster frame shown in FIG. 1.

Referring to the drawings in detail, wherein like numerals indicate like elements, there is shown in FIG. 1 a plaster frame in accordance with the present invention designated generally as 10. The plaster frame 10 may be installed in a conventional manner between adjacent joists before ceiling panels are applied. Also, the plaster frame 10 may be converted as will be explained hereinafter so that it may be introduced through a much smaller sized hole in an existing ceiling panel.

The plaster frame 10 includes a frame plate 12 which supports an open ended housing 14. The housing 14 is adapted to extend entirely through a hole 16 in the plate 12. Co-extensive with the hole 16, the plate 12 has a downwardly extending annular flange 18. Flange 18 is concentric with and surrounds the open end of the housing 14.

The housing 14 is supported within and/or coaxial with the hole 16 in an adjustable manner. Fasteners 22, accessible from within the open end of the housing 14, removably secure the housing 14 to an upstanding ear 20. Ear 20 is integral with and in one piece with the plate 12. Ear 20 is preferably punched out of the plate 12 and extending upwardly while lying in the same plane as the flange 18. Fastener 22 extends through a vertical slot 24 in the side wall of the housing 14 so that the vertical position of the housing 14 relative to the plate 12 may be adjusted as desired.

A bracket 26 is vertically adjustable and supported by the housing 14. Bracket 26 has a horizontally disposed arm from which depends an electrical receptacle 28. One end of wires extending through cable 30 are connected to the receptacle 28. The other ends of the wires are supported within a junction box 32.

The junction box 32 is secured to the top surface of plate 12 in any conventional manner. Box 32 has a spring clip 34 on at least one end thereof. The spring clip 34 is fixedly secured intermediate its ends to a side wall of the box 32 and has deformed end portions for releasably retaining at least one of the side walls 36 of the box 32 in assembled relationship. Clip 34 is resilient and when minipulated in a predetermined direction will facilitate removal of the side wall 36 to thereby provide access to the ends of the wires within box 32.

Sets of lugs 39 are bent out of the plate 12 along opposite edge portions of the plate 12. A pair of extendable brackets 38 (frequently called hanger bars) are provided along one side of the plate 12. A similar pair of extendable brackets 40 are provided along the opposite side of the plate 12. Each bracket 38 has a mounting flange 42. Each bracket 40 has a mounting flange 44. The brackets 38, 40 and the flanges 42, 44 facilitate mounting of the plaster frame 10 between adjacent joists.

As shown more clearly in FIG. 3, hole 16 is closer to side edge 48 of plate 12 as compared with side edge 50 of plate 12. A breakaway zone 46 is provided on the plate 12. Zone 46 has a length of at least one inch and preferably approximately 2 inches long. Breakaway zone 46 is integral with the plate 12 and has been partially severed or perforated so that it may be easily snapped off by applying force using a conventional tool such as a pair of pliers. When the zone 46 is broken away, there is provided a gap which will facilitate introducing the entire plaster frame through a hole 52 in a ceiling panel 54. Hole 52 has a diameter which is only slightly greater than the diameter of housing 14.

INSTALLATION

The plaster frame 10 as shown in FIG. 1 is installed between joists in a conventional manner. When it is desired to use the plaster frame 10 for installation behind the ceiling panel 54, the hole 52 is cut in the panel 54 after first measuring the diameter of the housing 14.

The plaster frame 10 is thereafter minipulated in the following manner. The brackets 38 and 40 are removed by pulling on their respective end flanges. Brackets 38, 40 are then discarded. The fasteners 22 are removed and housing 14 is then introduced downwardly through the hole 16. Thereafter, the breakaway zone 46 is removed. See FIG. 3 wherein the housing 14 has been moved to one side for purposes of illustration.

Figure 4:
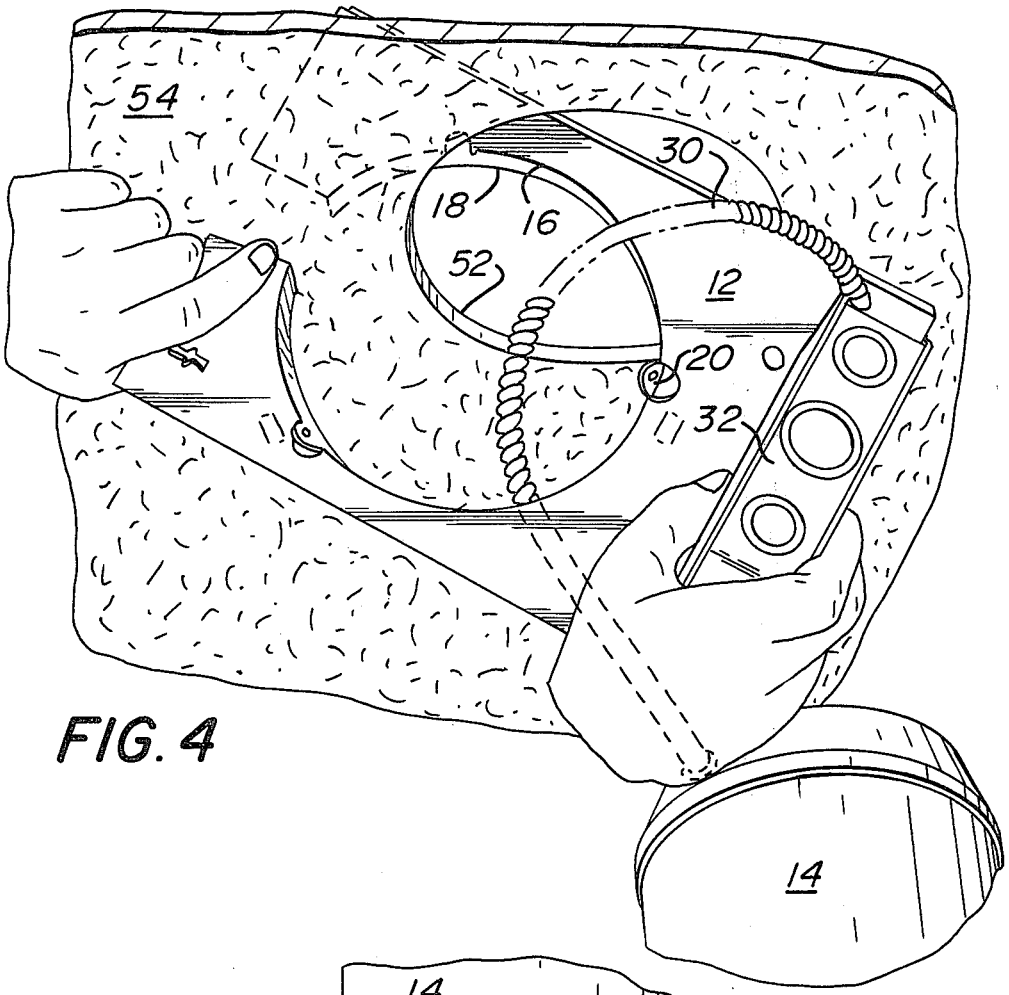
FIG. 4 is an illustration of the manner in which the plaster frame may be inserted through a hole in the ceiling.

As shown in FIG. 4, the housing 14 is below the plate 12 and cable 30 extends downwardly through the hole 16. Power wires are pulled through hole 52 and are connected to the wire ends in the box 32. The gap produced by removal of the breakaway zone 46 is now utilized to facilitate minipulation of the entire plaster frame 10 through the hole 52. Frame 10 must be minipulated by rotating the same as it is slipped through the hole 52.

Figure 5:
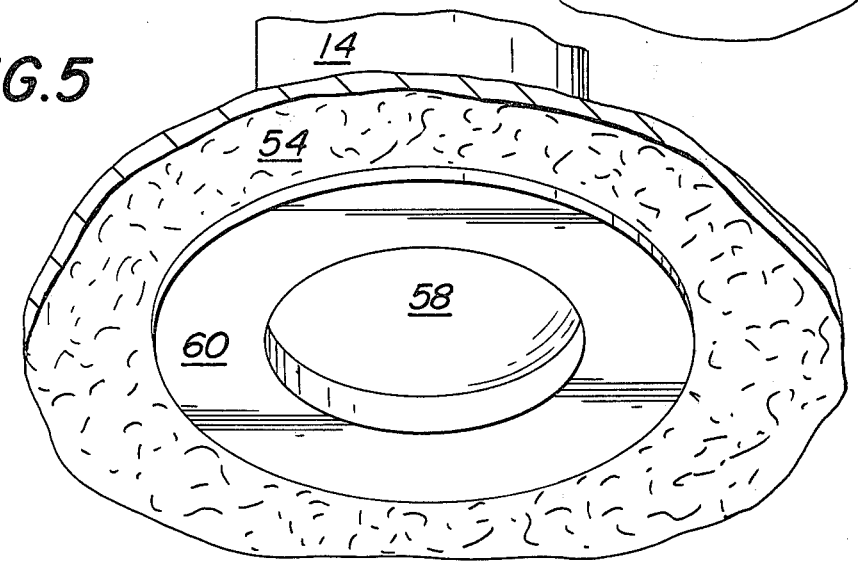
FIG. 5 is an illustration of the installed fixture in a ceiling.

Once the plaster frame 10 is above the ceiling panel 54 between adjacent joists, the housing 14 and the cable 30 are moved upwardly through the hole 52, through the hole 16 in plate 12, and then retained in place by attaching the fasteners 22. Retaining clips 61 which are generally L-shaped are then applied by slipping one leg over the bottom edge of flange 18 as shown in FIG. 2. The other leg of the clip 61 will then overlie the ceiling panel 54 to thereby retain the plaster frame 10 in place. A light source such as bulb 58 is then coupled to the receptacle 28. Thereafter, an annular trim plate 60 is coupled to the housing 14 in any convenient manner such as by using a spring having one end attached to plate 60 and the other end attached to lug 62 on housing 14. The completely installed fixture appears as shown in FIG. 5. A wide variety of bulbs 58 and trim plates 60 may be utilized including louvers, wall washer, eyeball, etc.

Typical dimensions on an embodiment of the present invention are as follows. The following dimensions are for purposes of illustration of an operative embodiment. Plate 12 is 12 inches long between the side edges 48 and 50 and $8\frac{1}{4}$ inches wide. The hole 16 has a diameter of 6.6 inches. The breakaway zone 46 has a length of $1\frac{1}{2}$ inches. Plate 12 is galvanized steel having a thickness of 0.036 inches. Flange 18 has an axial length of 0.625 inches. Housing 14 has a diameter of about $6\frac{1}{2}$ inches and a height of about $7\frac{1}{2}$ inches.

While the plaster frame 10 is particularly designed for installation as a recessed fixture in a ceiling, it may be adapted for installation in a wall. Various features of the plaster frame 10 as shown may be eliminated if desired. For example, the flange 18 on plate 12 is desirable but may be eliminated. Housing 14 may have a diameter smaller than the diameter of hole 16 by as much as $\frac{1}{2}$ inch. The breakaway zone 46 enables a plaster frame having dimensions of approximately 8 by 12 inches to be inserted through a $6\frac{1}{2}$ inch diameter hole in a ceiling panel. Plaster frame 10 may be sold with zone 46 removed if it is desired to only service the after market.

The present invention may be embodied in other specific forms without departing from the spirit or essential attributes thereof and, accordingly, reference should be made to the appended claims, rather than to the foregoing specification, as indicating the scope of the invention.

I claim:

1. A plaster frame adapted to be recessed behind a panel comprising a frame plate having a hole there through in a location wherein the hole is closer to one side edge as compared with the opposite side edge of the plate, said plate having cuts or perforations defining a breakaway zone extending between said hole and said one side edge of the plate, said breakaway zone being integral in one piece with the plate but weakened by said cuts or perforations so as to be removable from the plate, an open bottom housing removably mounted on said plate and concentric with said hole, said housing having a receptacle for receiving an electric light source, a box on said frame, wires extending from said receptacle to said box.

2. A plaster frame in accordance with claim 1 including adjustable hanger bars extensibly supported by said plate along said one edge and along said opposite edge, said hanger bars being completely removable from said plate, said side edges of said plate being the shorter sides of a rectangle.

3. A plaster frame in accordance with claim 1 wherein said housing is removably mounted on said plate by way of fasteners accessible through the open end of said housing.

4. A plaster frame in accordance with claim 1 wherein said housing is cylindrical with its outer diameter being slightly smaller than the diameter of said hole in the frame plate so that the housing may extend completely through the hole.

5. A recessed electrical lighting fixture comprising a rectangular metal plate having first and second shorter sides, said plate having a hole therethrough, said hole being closer to said first shorter side than said second shorter side, an integral breakaway zone extending between said hole and said first shorter side, said zone when removed facilitating introducing the frame plate through a hole in a ceiling panel and wherein the ceiling panel hole is approximately the same size as said hole in said plate, an open bottom housing removably mounted on said plate coaxial with the plate hole and being of a size so that it may extend entirely through said plate hole from below the plate, said housing having an electrical receptacle for receiving an electric bulb, a box on said frame, a prewired cable extending from said box to said receptacle.

6. A fixture in accordance with claim 5 including a pair of extensible hanger bars adjustably connected to said plate along said first and second sides, at least said hanger bars along said first side being completely removable.

7. A lighting fixture in accordance with claim 1 including means to adjustably vary the elevation of the housing with respect to the elevation of said plate by way of fastener means accessible through the open end of said housing.

8. A lighting fixture in accordance with claim 5 wherein said plate has a downwardly extending annular flange surrounding said hole in said plate.

9. A plaster frame adapted to be recessed behind a panel comprising a rectangular frame plate having a hole therethrough in a location wherein the hole is closer to one side edge as compared with the opposite side edge of the plate, said plate having a gap extending between said hole and said one side edge of the plate, an open bottom housing removably mounted on said plate by way of fasteners accessible through the open bottom end of said housing, said housing being concentric with said hole, said housing having a receptacle for receiving an electric light source, a box on said frame, and wires extending from said receptacle to said box.

10. A plaster frame in accordance with claim 9 wherein said housing is cylindrical with its outer diameter being slightly smaller than the diameter of said hole in the frame plate so that the housing may extend completely through the hole.

* * * * *